US007331298B2

(12) United States Patent
Barkdoll et al.

(10) Patent No.: US 7,331,298 B2
(45) Date of Patent: Feb. 19, 2008

(54) COKE OVEN ROTARY WEDGE DOOR LATCH

(75) Inventors: Michael P. Barkdoll, Knoxville, TN (US); Mark A. Ball, Richlands, VA (US); Richard E. Taylor, Vansant, VA (US); Terry D. Taylor, Vansant, VA (US); Dexter J. Mounts, Raven, VA (US); Ronnie E. Stacy, Grundy, VA (US); John W. Crigger, Oakwood, VA (US); Darrell E. Horn, Pilgrims Knob, VA (US); William H. Stacy, Grundy, VA (US)

(73) Assignee: SunCoke Energy, Inc., Knoxville, TN (US)

( * ) Notice: Subject to any disclaimer, the term of this patent is extended or adjusted under 35 U.S.C. 154(b) by 623 days.

(21) Appl. No.: 10/933,866

(22) Filed: Sep. 3, 2004

(65) Prior Publication Data

US 2006/0049641 A1 Mar. 9, 2006

(51) Int. Cl.
*F23M 7/00* (2006.01)

(52) U.S. Cl. ..... 110/173 R; 110/176; 202/248

(58) Field of Classification Search ..... 202/248, 202/81; 126/191, 192, 197; 292/201; 110/176, 110/177, 178, 173 R
See application file for complete search history.

(56) References Cited

U.S. PATENT DOCUMENTS

| | | | | |
|---|---|---|---|---|
| 3,876,506 A | | 4/1975 | Dix et al. | |
| 4,225,393 A | * | 9/1980 | Gregor et al. | 202/248 |
| 4,439,277 A | | 3/1984 | Dix | |
| 5,670,025 A | * | 9/1997 | Baird | 202/248 |

FOREIGN PATENT DOCUMENTS

| | | |
|---|---|---|
| GB | 606340 | 8/1948 |
| GB | 611524 | 11/1948 |

* cited by examiner

*Primary Examiner*—Kenneth Rinehart
(74) *Attorney, Agent, or Firm*—Luedeka, Neely & Graham, PC

(57) ABSTRACT

An oven door latch system for a coke oven door positionable within an oven door opening and method of sealing a coke oven. The door latch system includes a rotary member rotatively attachable to the oven door. The rotary member has a wedge-shaped, arcuate engagement edge for variably engaging a striker plate on a buck stay member adjacent the oven door opening when the oven door is disposed in the opening of the oven. A tab member is also included on the rotary member. A remotely operated adjustment actuator is provided for engaging the tab member to rotate the rotary member in conjunction with an oven door opening or closing operation. Enhanced oven door sealing is provided by the rotary wedge latch system.

21 Claims, 10 Drawing Sheets

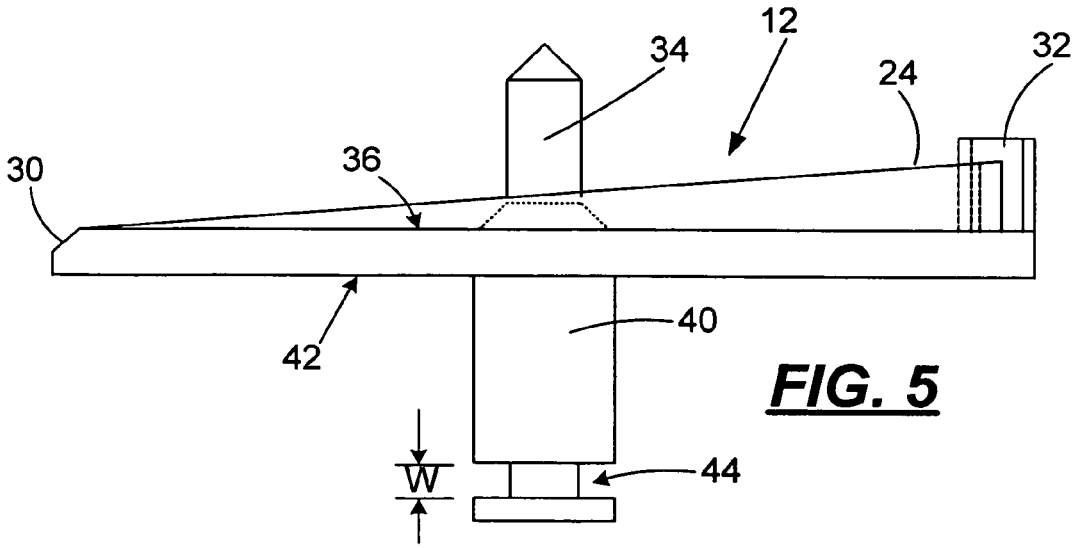
FIG. 5
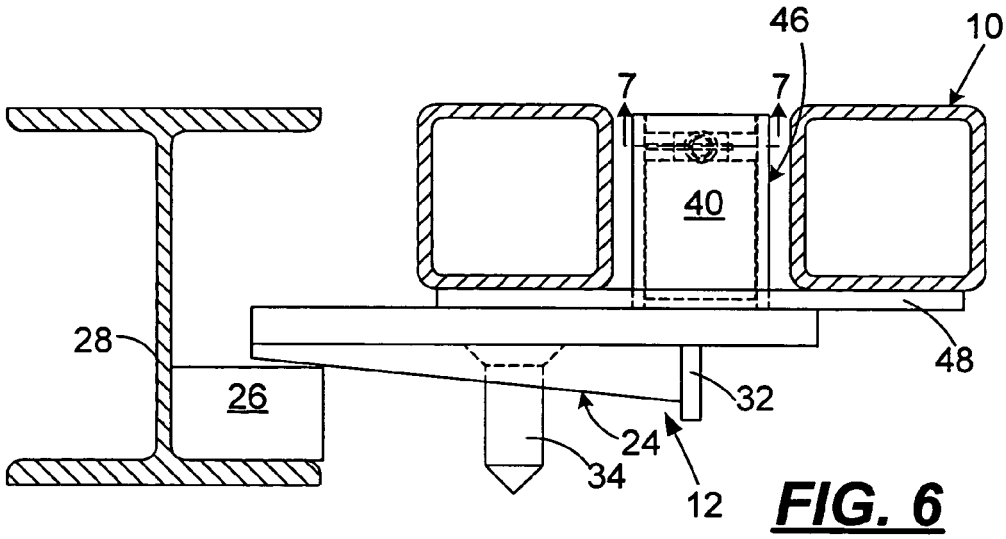
FIG. 6
FIG. 7
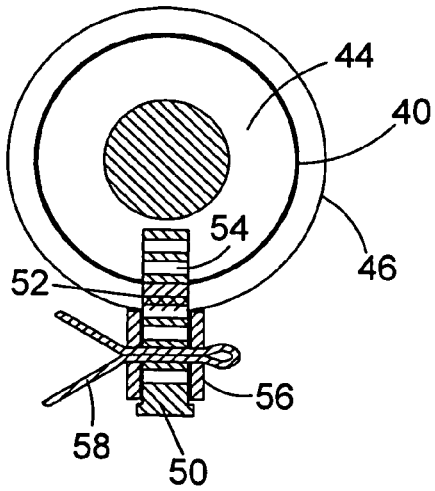

COKE OVEN ROTARY WEDGE DOOR LATCH

FIELD OF THE DISCLOSURE

The disclosure relates to an improved oven door latch mechanism and more particularly to a rotary wedge latch system for sealing an oven door during a coking operation.

BACKGROUND

Coke oven doors for horizontal coke ovens have been a source of air leakage during the coking cycles. Each horizontal coke oven has two doors. One door is located on a coal charging side of the oven and a second door is located on a coke discharge side of the oven. Each of the doors is made of a combination of refractory and metal and is very large and heavy. The doors are required to close the oven to maintain the heat inside the coke ovens which may range from about 1000° to about 1500° C., and to maintain a negative pressure inside the oven. A negative pressure is required to move flue gases and combustion products away from the coke bed in the oven.

Since the ovens operate under a negative pressure, it is important that both the charging door and the coke discharge door remain closed as tightly as possible, and that the doors remain tightly closed throughout the coking cycle. A tightly closed door means that the door is held tightly against the oven door jamb, lintel, and sill plate. Loose doors allow excessive air infiltration which can result in poor product quality or low product yields. Excess air entering the oven can come in contact with very hot coke (1000+° C.). Once contact is made, the air bums the coke product thereby reducing its value and leading to product yield loss.

Conventional door latches used to maintain the doors in a closed relationship with the coke ovens consist of cam latches that are manually adjusted. The cam latches engage a backside of a front flange of a beam which is disposed on each side of the oven door. There are typically four cam latches per door.

Door latch closing requires that a worker apply force to a wrench that is used to rotate and tighten the cam latches. Such force may lead to back strains and other injuries. Furthermore, a worker can apply only about 600 kilograms of force to each cam latch. This amount of force may not be sufficient to overcome slight irregularities, such as warping, bending, and solids buildup, of either the door frame or the door jamb. Accordingly, the doors may not be closed as tightly as necessary to reduce or prevent excess air infiltration into the oven.

During a 48 hour coking cycle there are small movements of the oven relative to the door. These movements are a result of differential thermal expansion. Such movements have a tendency to make the cam latches rotate slightly and become loose. Typically about 25 to 50 percent of the cam latches become loose during a coking cycle. Accordingly, significant manpower is required to monitor and adjust the cam latches for efficient coke oven operation.

Accordingly, there is a need for a door latch system that is less prone to movement or loosening and that can be positioned automatically rather than manually during an oven door closing operation.

SUMMARY

With regard to the above and other needs and objective, there is provided, in one embodiment, an oven door latch system for a coke oven door positionable within an oven door opening and method of sealing a coke oven. The door latch system includes a rotary member rotatively attachable to the oven door. The rotary member has a wedge-shaped, arcuate engagement edge for variably engaging a striker plate on a buck stay member adjacent the oven door opening when the oven door is disposed in the opening of the oven. A tab member is also included on the rotary member. A remotely operated adjustment actuator is provided for engaging the tab member to rotate the rotary member in conjunction with an oven door opening or closing operation. Enhanced oven door sealing is provided by the rotary wedge latch system.

In another embodiment there is provided a method for reducing air leakage through a door opening of a coke oven when a coke oven door is disposed in the door opening to close the door opening. The method includes providing an oven door latch system for a coke oven door. The door latch system contains a rotary member rotatively attached to the oven door. The rotary member has a wedge-shaped, arcuate engagement edge for variably engaging a striker plate on a buck stay member adjacent the oven door opening when the oven door is disposed in the opening of the oven. The rotary member also includes a tab member thereon for moving the rotary member from an engaged position adjacent the striker plate to a non-engaged position remote from the striker plate. A remotely operated adjustment actuator is provided for moving the rotary member from the engaged position to the non-engaged position. During a door closing operation, the coke oven door is disposed in the door opening. The adjustment actuator is engaged with the rotary member. As the adjustment actuator is actuated, the actuator rotates the rotary member so that an increasing wedge portion of the rotary member is engaged with the striker plate of the buck stay adjacent the oven door.

In yet another embodiment there is provided an oven door latching mechanism for sealing an oven door of a furnace. The mechanism includes rotary wedge means attached to the oven door for variably engaging a striker plate of an oven buck stay. Also includes is actuator means remote from the oven door for rotating the rotary wedge means from an engaged position adjacent the striker plate to a non-engaged position remote from the striker plate.

An important advantage of the mechanism and method described herein is that the rotary wedge member is substantially self-adjusting once the wedge member is engaged with the striker plate of the oven buck stay. The self-adjustment feature of the latch system means that the latches do not loosen during oven heating cycles thereby reducing air leakage into the oven. In fact, movement of the latches, if any, tends toward increased door sealing.

Another advantage of the system is that the door latches can be positioned using a relatively simple adjustment mechanism rather than manpower force to seal an oven door. The system may thus lead to a reduction in back strain injuries and a reduction in manpower required to operate the ovens. Furthermore, each of the rotary wedge members on an oven door provide independent door sealing force for sealing an oven door even if the oven door is cocked.

BRIEF DESCRIPTION OF THE DRAWINGS

Further advantages of the disclosed embodiments will become apparent by reference to the detailed description of preferred embodiments when considered in conjunction with the following drawings illustrating one or more nonlimiting aspects of the embodiments, wherein like reference characters designate like or similar elements throughout the several drawings as follows:

FIG. 5 is a side view, not to scale, of a latch for an oven door according to the disclosure;

FIG. 6 is a representative illustration, not to scale, of use of a latch according to the disclosure;

FIG. 7 is a cross-sectional view, not to scale, a retaining device for a latch according to the disclosure;

DETAILED DESCRIPTION OF PREFERRED EMBODIMENTS

Coke ovens, particularly non-recovery coke ovens, are typically provided in a battery of ovens in a coke plant. A coking cycle for each of the ovens is about 48 hours depending on the size of the ovens. Accordingly, there is periodic discharging of coke from an oven and charging coal to the oven. Mechanical devices have been devised for charging coal and discharging coke from the ovens. The devices include mechanisms for removing and replacing the oven doors of a horizontal coking oven during the charging and discharging operations. A general description of such devices and coke oven operation is contained in U.S. Pat. No. 5,447,606 to Pruitt, the disclosure of which is incorporated herein by reference.

As indicated above, oven doors are removed during coal charging and coke discharging operations. A typical oven door contains a plurality of latches for sealing the oven door. However, conventional latches fail to be self-adjusting, and in many instances, require constant adjustment due to loosening. Accordingly, an improved oven door latch system is provided.

Figure 2:
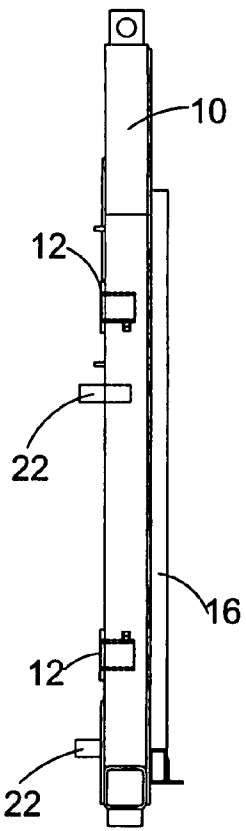
FIG. 2 is a plan side view, not to scale, of an oven door containing a latch according to the disclosure.
Figure 1:
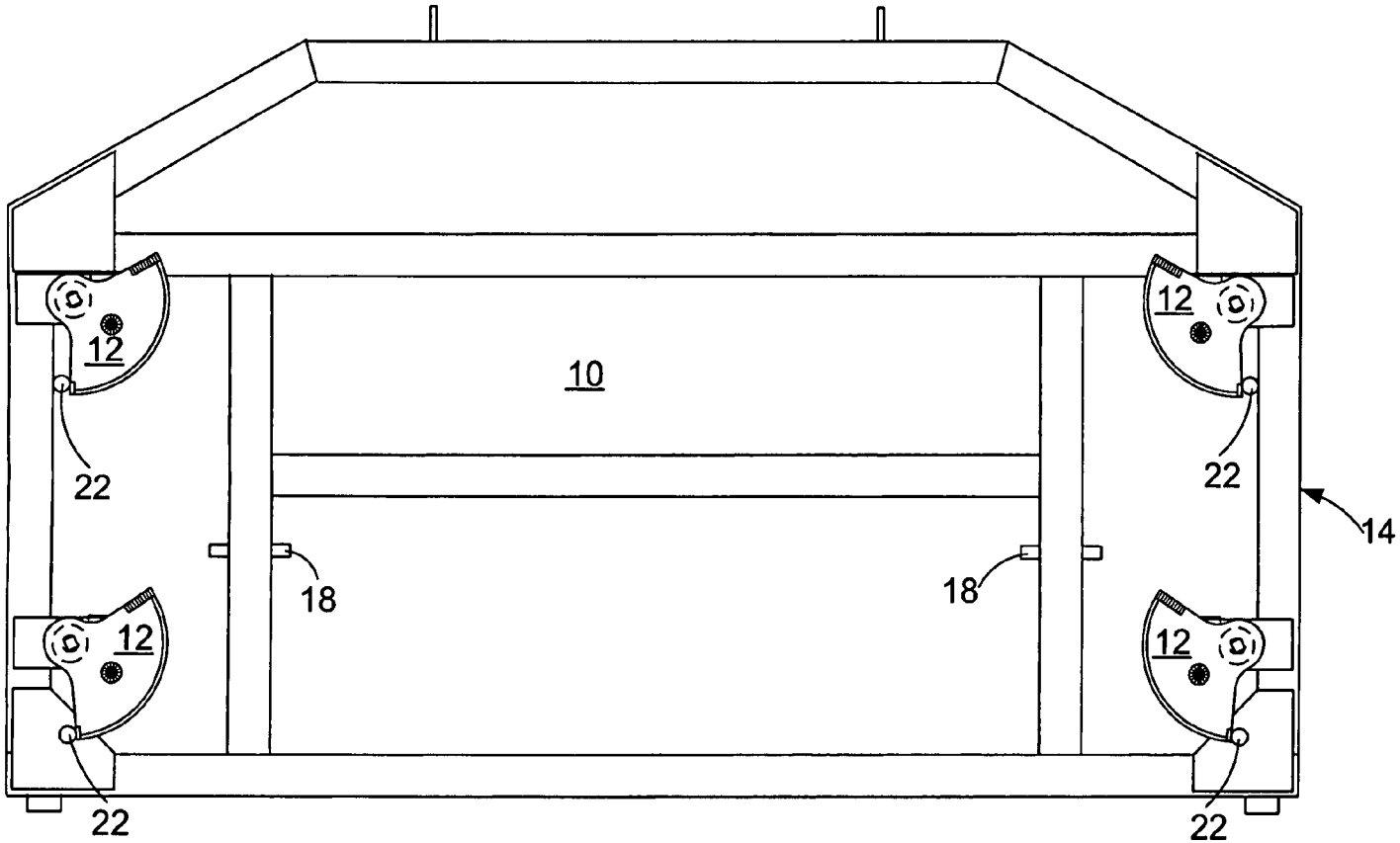
FIG. 1 is a plan view front view, not to scale, of an oven door containing a latch according to the disclosure.

As shown in FIGS. 1 and 2, an oven door 10, according to embodiments described herein, contains a plurality of rotary latches 12 disposed adjacent a periphery 14 of the door 10. In FIG. 1, four of the latches 12 are illustrated. However, an oven door may contain more or fewer of the latches 12 depending on the size of the door, the size of the latches 12, and other design criteria for a particular coke oven. As shown in FIG. 1, the latches 12 are disposed in a position suitable for removing and replacing the door 10 in a coke oven opening. For the purposes of this disclosure, the door 10 may be a coal charging door or a coke discharge door.

The oven door 10 is preferably a door made of steel and having a refractory material 16 applied to an oven side of the door. During an oven door removal and replacement operation, a utility car is positioned adjacent the door 10 to lift the door 10 out of an oven opening using lifting tabs 18. Stop members 22 are fixedly attached to the oven door 10, as by welding, to prevent the latches 12 from rotating and engaging structural oven members such as buck stays. Accordingly, for each latch 12 there is a corresponding stop member 22.

Figure 3:
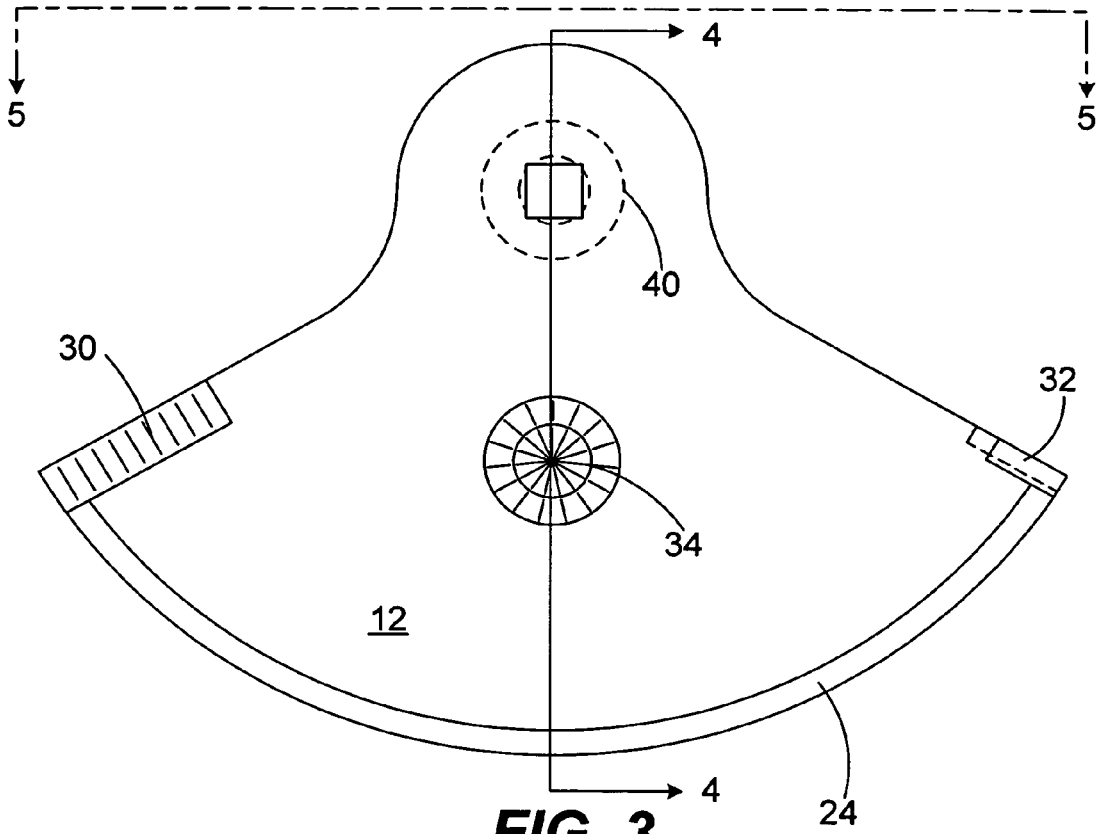
FIG. 3 is a plan top view, not to scale, of a latch for an oven door according to the disclosure.
Figure 4:
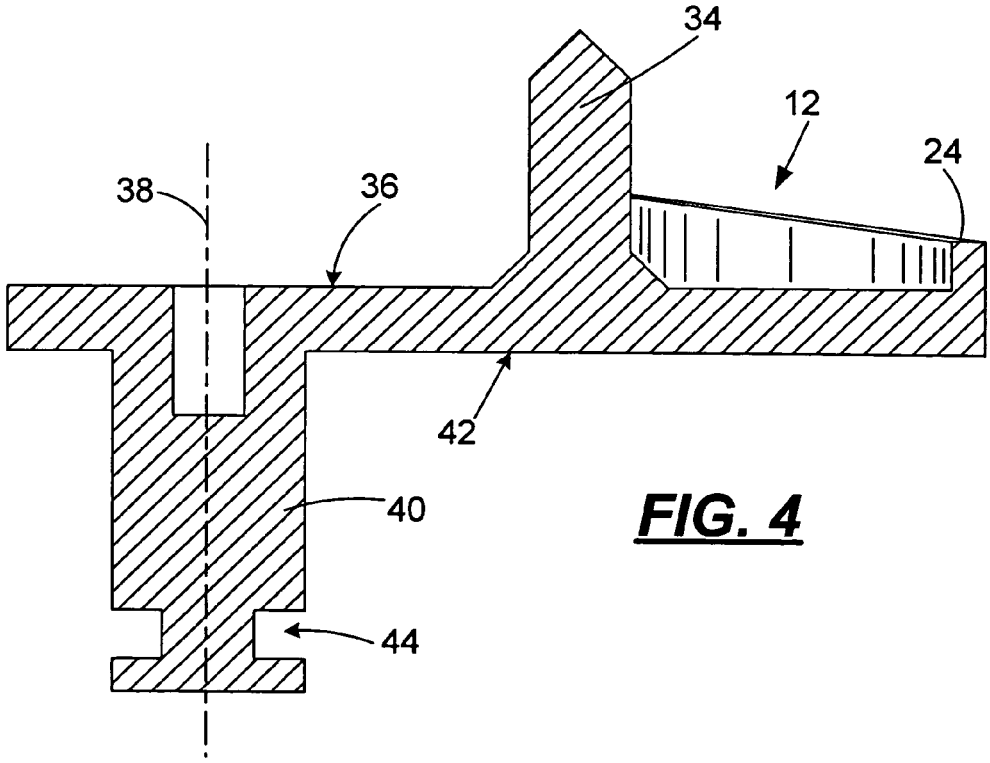
FIG. 4 is a cross-sectional view, not to scale, of the latch of FIG. 3.

A preferred rotary wedge latch 12 according to embodiments described herein is illustrated in detail in FIGS. 3-5. The latch 12 includes an arcuate, wedge-shaped edge 24 for variably engaging a striker plate 26 fixedly attached to an oven buck stay 28 as illustrated in FIG. 6. The latch 12 includes a beveled or chamfered edge 30 for initially engaging the striker plate 26 and providing a relatively smooth transition to the wedge-shaped edge 24 of the latch 12. An opposing end of the arcuate edge 24 includes a stop plate 32 for contact with the stop member 22 of the oven door 10. The latch 12 may be made of any suitable resilient metal or alloy, including but not limited to, hardened steel having a thickness sufficient to withstand pressures on the latch 12 caused by expansion and contraction upon heating and cooling of the oven and oven door 10.

The arcuate edge 24 has a length sufficient to gradually engage the striker plate 26 upon movement of the oven door 10 during expansion and contraction thereof due to atmospheric condition changes and oven temperature changes. Accordingly, the edge 24 may preferably have an arcuate length ranging from about 80 to about 180 degrees, most preferably about 120 degrees providing the edge 24 with a slope ranging from about 0.04 to about 0.10 millimeters per millimeter arcuate length. The overall length of the arcuate edge 24 may preferably range from about 40 to about 100 centimeters or more.

Also included on the latch 12 is a tab member 34 for use in rotating the latch 12 from a position as shown in FIG. 1 to a position as shown in FIG. 6 wherein the edge 24 engages the striker plate 26. As shown in FIGS. 4-6, the tab member 34 extends substantially perpendicularly from a first surface 36 of the latch 12 on a side thereof coexistent with the edge 24. The tab member 34 is also disposed between a pivot axis 38 of the latch 12 and the edge 24. The pivot axis 38 of the latch 12 is provided by a pivot pin 40 pendent from a second surface 42 of the latch 12. The pivot pin 40 includes a circumferential groove 44 for use in retaining the pivot pin 40 in a cylindrical conduit 46 (FIG. 6) for rotation therein.

With reference to FIG. 6, a portion of the door 10 is illustrated with one of the latches 12, attached to the door 10. The door 10 includes a plate 48 attached thereto, as by bolting or welding, and the cylindrical conduit 46 attached to the plate 48. The latch 12 is attached to the door 10 by inserting the pivot pin 40 into the cylindrical conduit 46. A retaining pin 50 is then inserted into an opening 52 in the cylindrical conduit 46 so that at least an end portion 54 of the retaining pin 50 is disposed in the groove 44 as shown in FIG. 7. The retaining pin 50 may be threadingly attached to the cylindrical conduit 46 or may be inserted through a nipple 56 and retained therein by a removable fastening device such as a cotter pin 58. The retaining pin 50 is slightly smaller in diameter than a width W of the groove 44 so that the pivot pin 40 is free to rotate within the cylindrical conduit 46.

Figure 8:
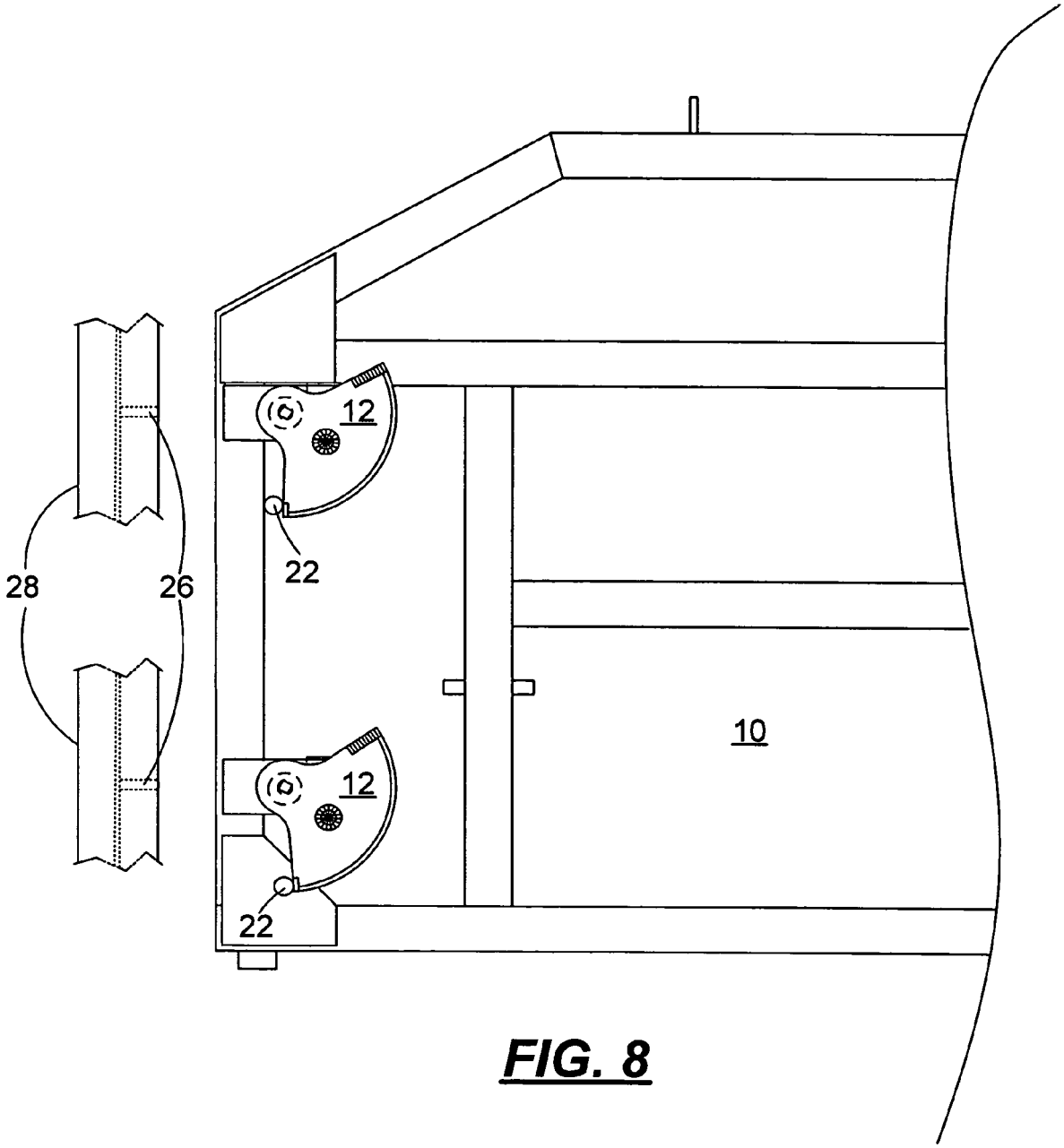
FIG. 8 is a plan front view, not to scale, of a portion of an oven door with a latch according to the disclosure in a first position.
Figure 9:
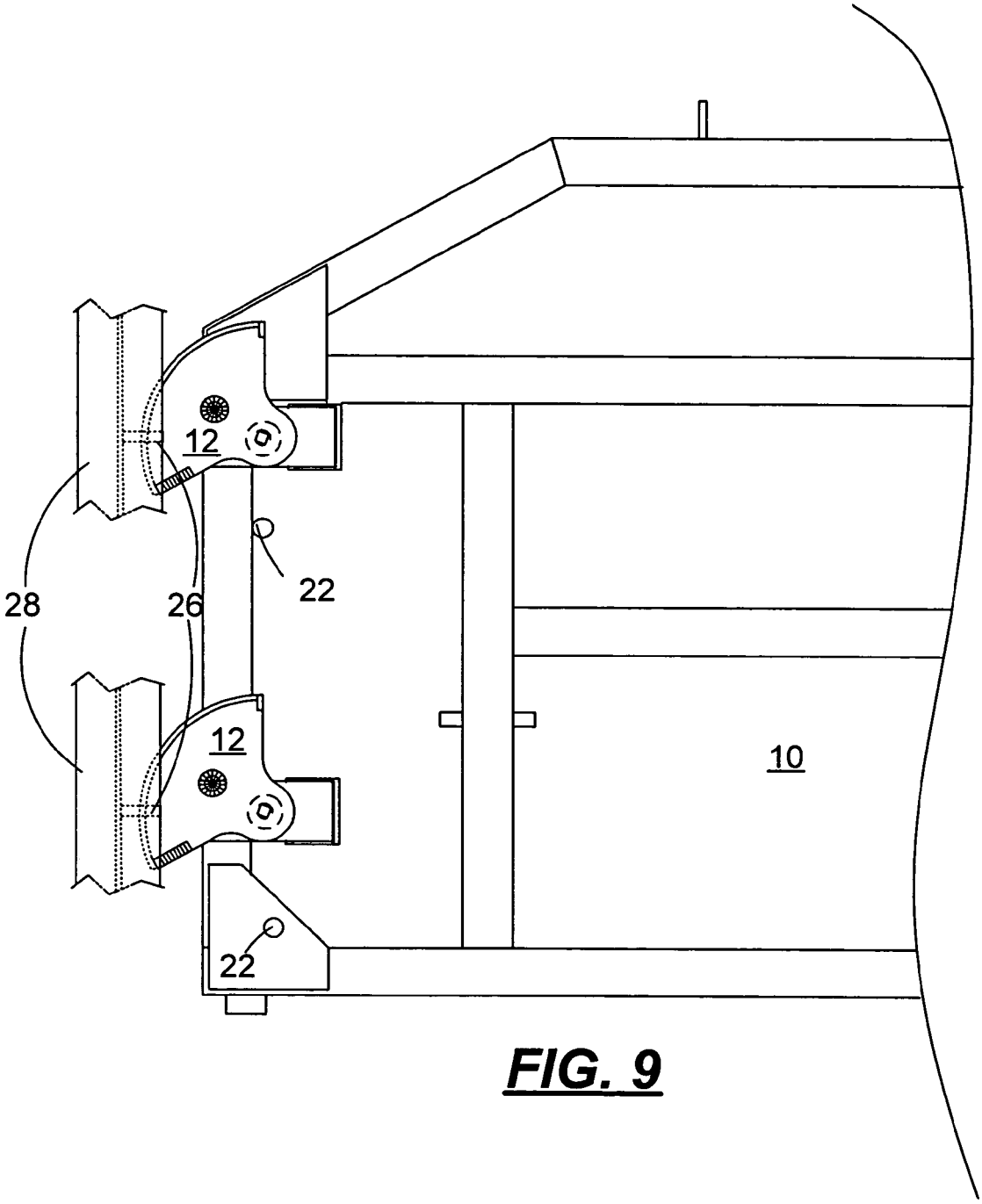
FIG. 9 is a plan front view, not to scale, of a portion of an oven door with a latch according to the disclosure in a second position.
Figure 10:
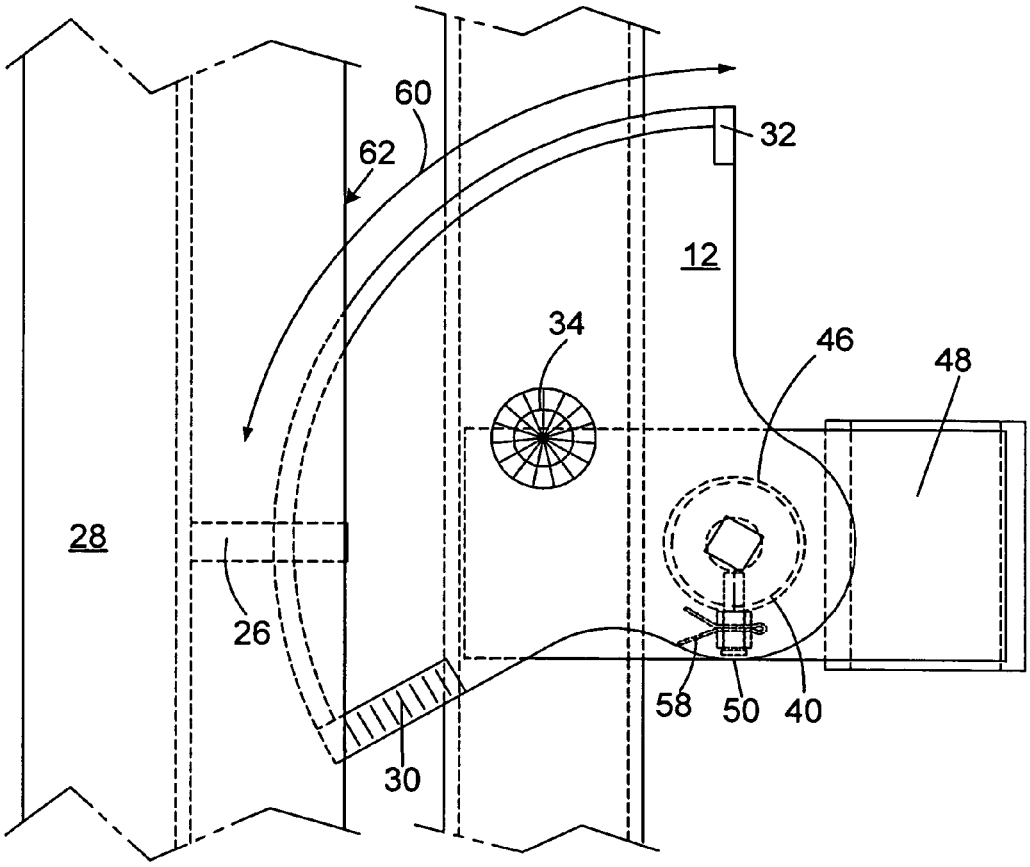
FIG. 10 is an enlarged view, not to scale, of a latch according to the disclosure in a second position.

As shown in sequence in FIGS. 8 and 9, during a door closing operation, the latch 12 is rotated from a first position (FIG. 8) wherein the edge 24 of the latch is not engaged with the striker plate 26 of the buck stay 28, to a second position (FIG. 9) wherein the edge 28 of the latch 12 is engaged with the striker plate of the buck stay 28. As shown in FIG. 10, as the latch 12 is rotated along a path represented by arrow 60, the chamfered edge 30 contacts or comes into close proximity with the striker plate 26 thereby guiding the striker plate 26 over the edge 24 of the latch 12. Over or excessive rotation of the latch is prevented by abutting the stop plate 32 adjacent the striker plate 26 or edge 62 of the buck stay 28 should the stop plate 32 approach the striker plate 26 during an oven door closing operation.

Figure 11:
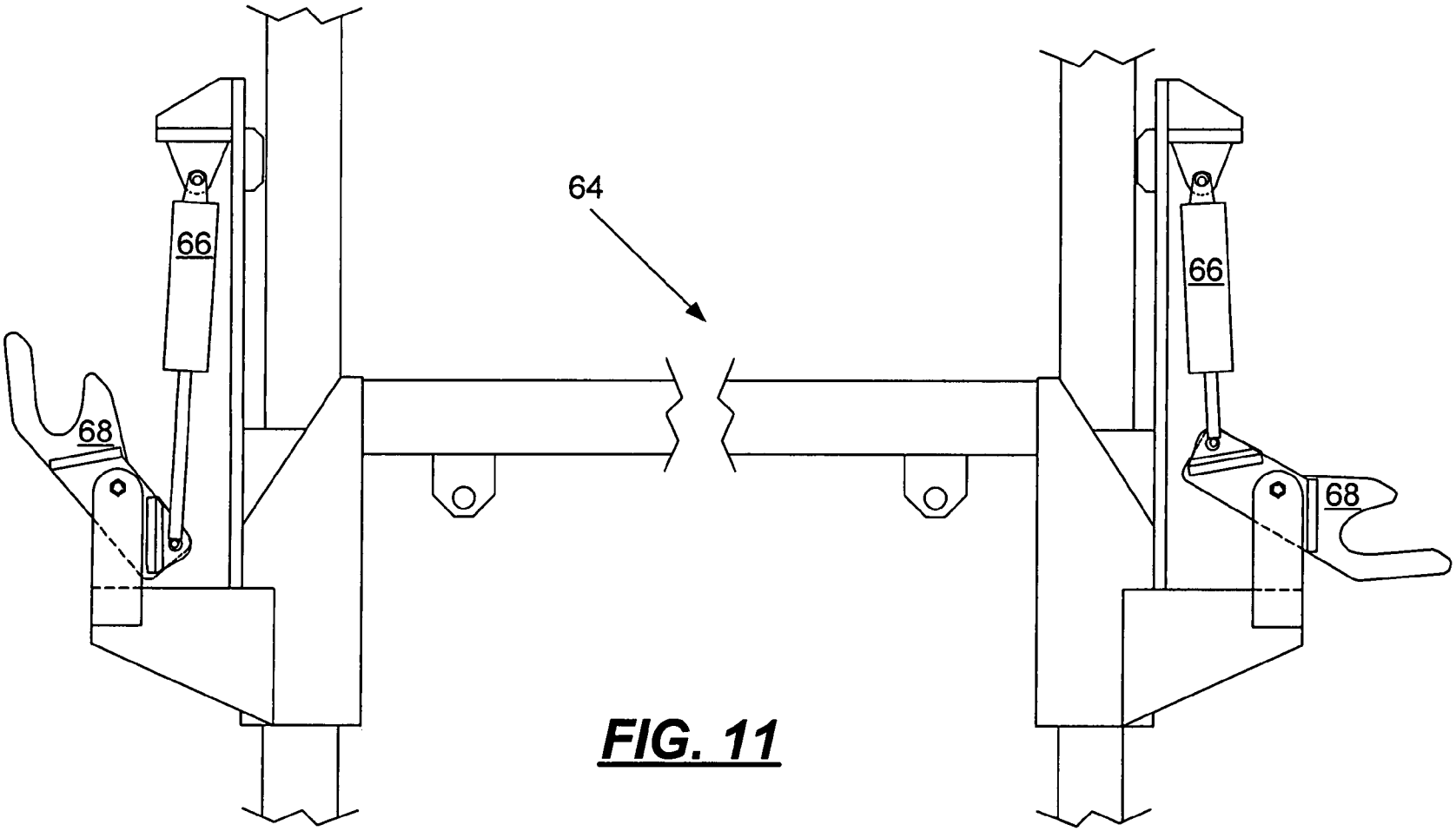
FIG. 11 is a plan view, not to scale of a portion of an actuator mechanism for a latch according to the disclosure.

An actuator mechanism 64 for rotating the latch 12 is illustrated in FIG. 11. The actuator mechanism 64 is remote from the oven door 10 and may be included on a utility car or other portable device for moving adjacent the oven door 10 during an oven charging and/or discharging operation. In the embodiment illustrated in FIG. 11, the actuator mechanism 64 includes double acting cylinders 66 attached to lever members 68. The double acting cylinders 66 may be hydraulic or air operated cylinders that move the lever members 68 from a first position as shown on the right side of FIG. 11 to a second position as shown an the left side of FIG. 11.

Figure 12:
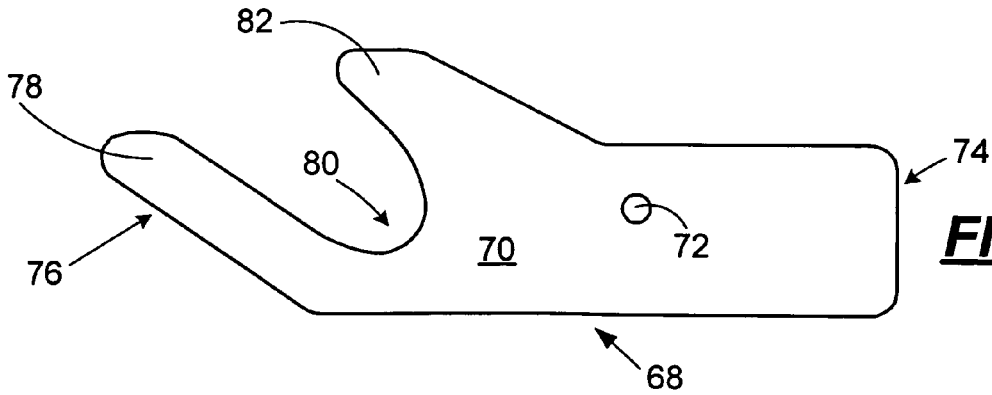
FIG. 12 is a plan view, not to scale, of an actuator mechanism for a latch according to the disclosure.
Figure 13:
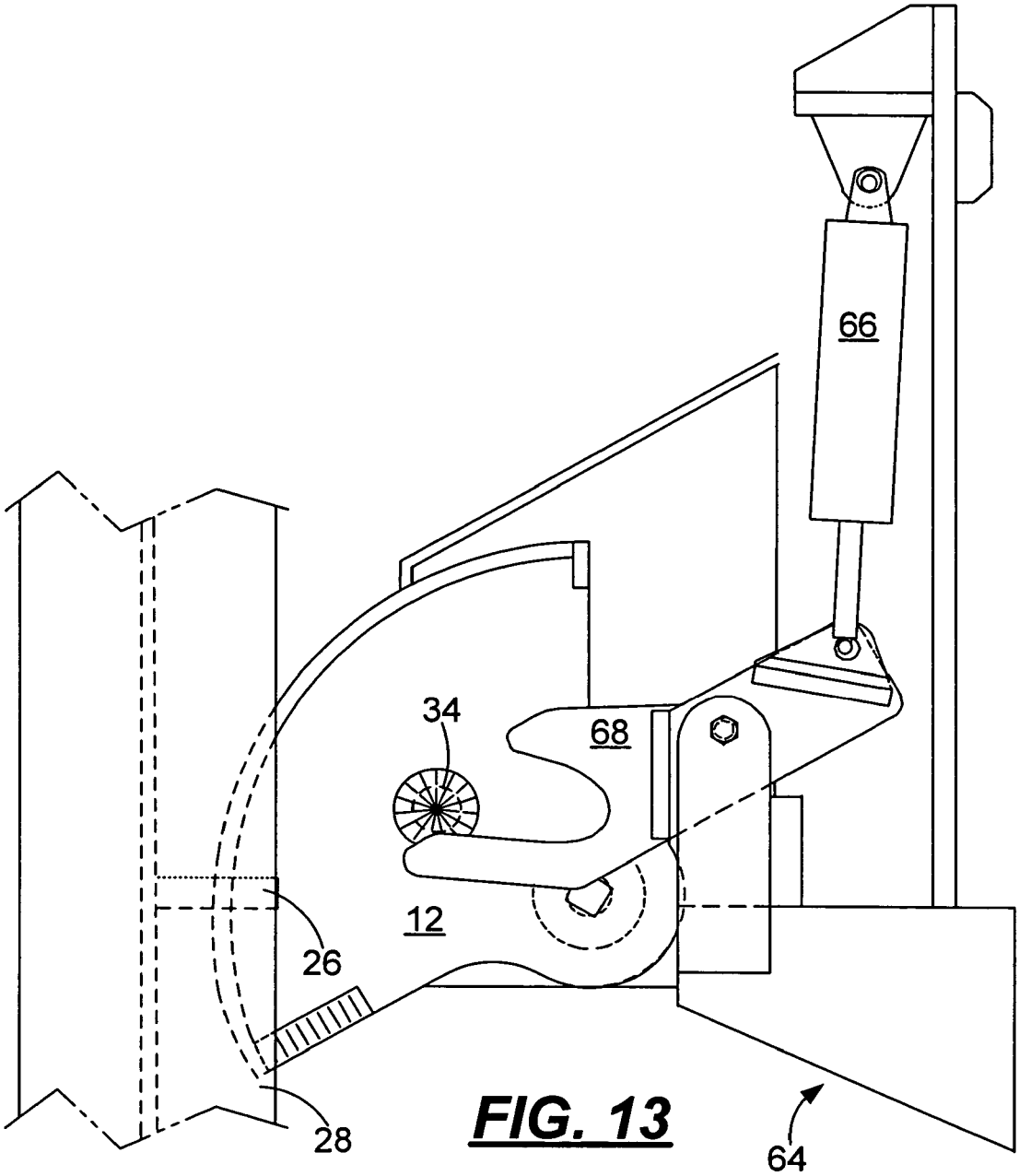
FIGS. 13 and 14 are enlarged views, not to scale, illustrating operation of a latch and actuator mechanism according to the disclosure.
Figure 14:
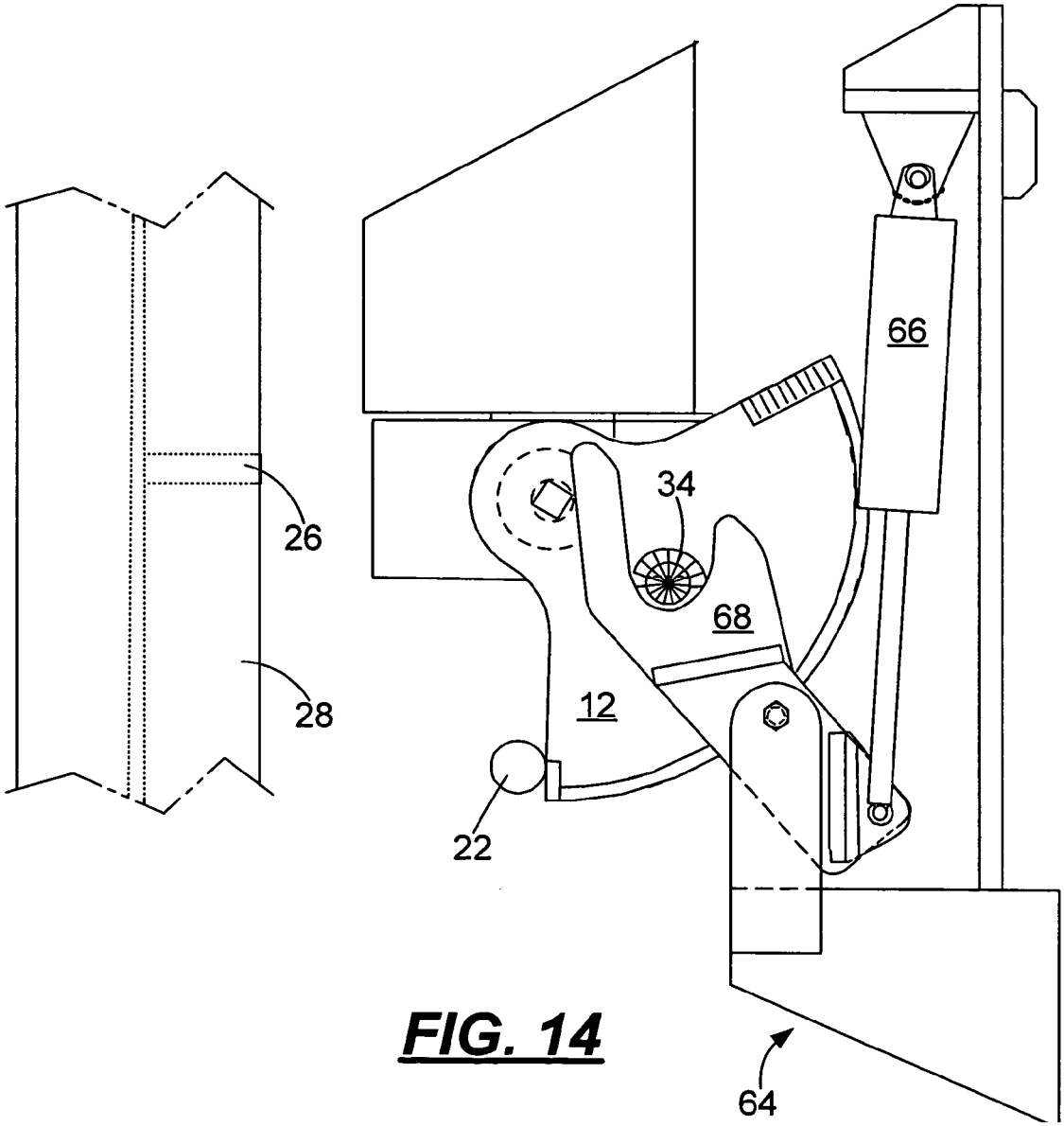

A detail of the lever member 68 is shown in FIG. 12. The lever member 68 includes an elongate arm 70 having a pivot opening 72 disposed between an actuator end 74 and an engagement end 76. As described in more detail below, the lever member 68 contains a first finger member 78 for engaging the tab member 34 of the latch 12 as the actuator mechanism 64 is used to rotate the latch 12 from the second position shown in FIG. 9 to the first position shown in FIG. 8 during a door opening operation. As the lever member 68 pivots about an axis through the pivot opening 72, the tab member 34 is urged toward a trough area 80 between the first finger member 78 and a second finger member 82, as shown in FIGS. 13 and 14.

During a coke oven charging operation, a pushing and charging machine is disposed adjacent a charging door and a utility car is disposed adjacent a coke discharge door of the oven. Both doors are removed from the oven and the coke is pushed out of the oven by a ram on the pushing and charging machine. Once the coke is removed from the oven, the coke discharge door is secured to the coke discharge side of the oven. Coal is then charged into the oven through the charging side of the oven. Once the oven is charged with coal, the charge door is secured to the oven. After the coking cycle is complete, the discharging and charging process is repeated.

When a utility car or pushing and charging machine containing the actuator mechanism 64 is adjacent the door 10 of an oven, to place or seat the door in a door jamb of the oven, a door lift mechanism exerts pressure on the door 10 thereby slightly deforming the oven opening. As the oven opening is deformed, the actuator mechanism 64 is activated to rotate the latches 12 into the second position shown in FIG. 9. Little force is needed to rotate the latches 12 as the latches 12 freely rotate until edge 12 is in contact with the striker plate 26. Any further deformation of the oven door 10 inward toward the oven will enable the latches 12 to rotate as by gravity to more tightly engage striker plate 26 when the pressure on the door 10 is released.

Likewise, when removing a door 10 from the oven opening, pressure is applied to the door 10 by the pushing and charging machine or utility car thereby decreasing the pressure of the striker plate 26 on edge 24 of the latches 12. As before, very little force is needed to rotate the latches 12 using the actuator mechanism 64 when the door 10 is forced in the door jamb of the oven.

Figure 15:
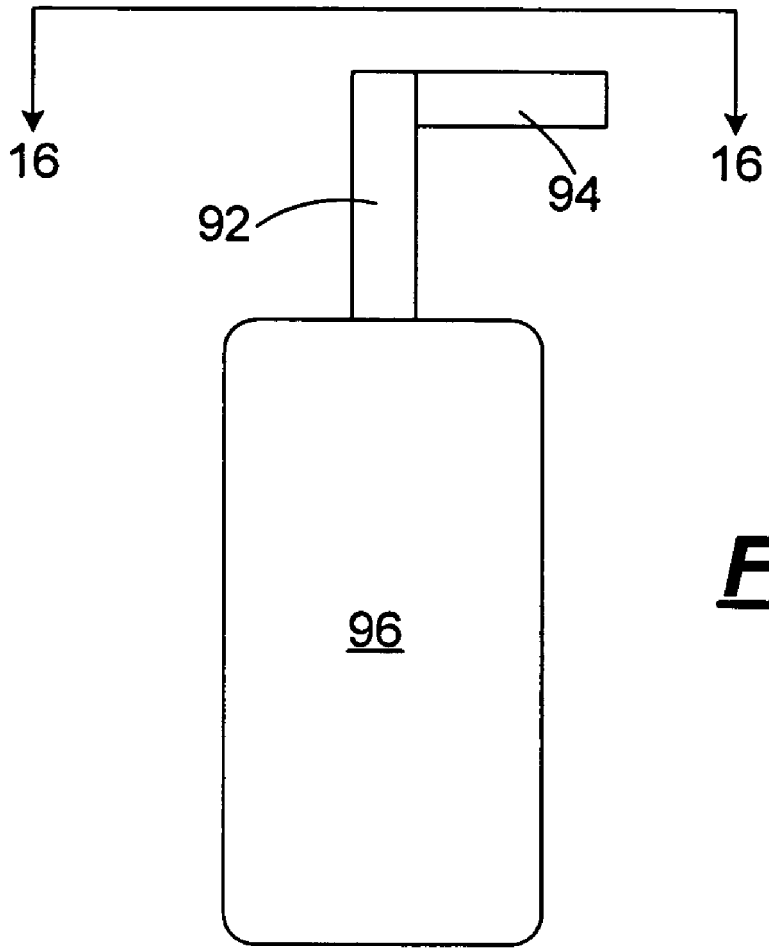
FIGS. 15 and 16 are plan and top views, not to scale, of an alternative actuator mechanism for a latch according to the disclosure.
Figure 16:
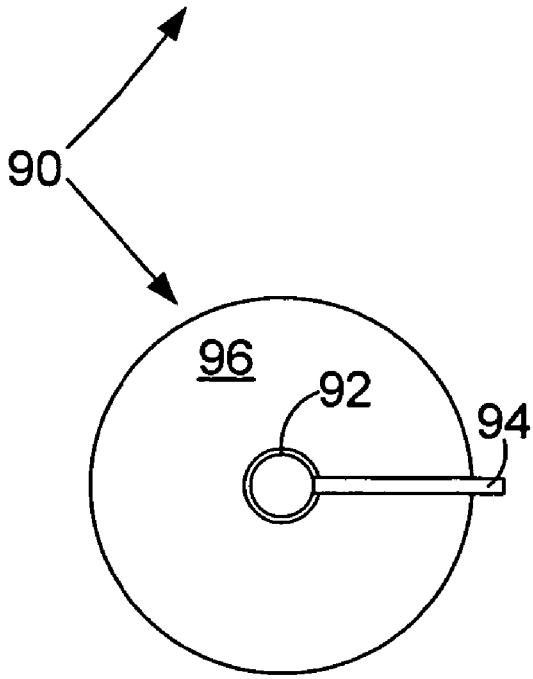

Yet another actuator mechanism 90 that may be used to engage the tab member 34 for rotating the latch 12 is illustrated in FIGS. 15 and 16. In this embodiment, the actuator mechanism 90 includes a rotating shaft 92 and a paddle member 94 attached to the shaft 92. As the paddle member 94 rotates, it engages the tab member 34 of the latch causing the latch 12 to rotate as described above. In this case, the shaft 92 may rotate about 360° during an engagement operation. The shaft 92 may be rotated as by an electric motor 96, hydraulic motor, pneumatic motor, or other suitable device to rotate the shaft 92 and apply sufficient force on the tab member 34 to rotate the latch 12.

It is contemplated, and will be apparent to those skilled in the art from the preceding description and the accompanying drawings, that modifications and changes may be made in the embodiments described herein. Accordingly, it is expressly intended that the foregoing description and the accompanying drawings are illustrative of preferred embodiments only, not limiting thereto, and that the true spirit and scope of the present embodiments be determined by reference to the appended claims.

What is claimed is:

1. An oven door latch system for a coke oven door positionable within an oven door opening, the door latch system comprising:

a rotary member rotatively attachable to the oven door and having a wedge-shaped, arcuate engagement edge for variably engaging a striker plate on a buck stay member adjacent the oven door opening when the oven door is disposed in the opening of the oven, the rotary member having a tab member thereon; and a remotely operated adjustment actuator for engaging the tab member to rotate the rotary member in conjunction with an oven door opening or closing operation.

2. The oven door latch system of claim 1, wherein the oven door further comprises a stop member for terminating rotation of the rotary member at a predetermined location.

3. The oven door latch system of claim 1, wherein the remotely operated adjustment actuator comprises a hydraulic cylinder and a lever member, the lever member having a first end for engaging the tab member and a second end attached to the hydraulic cylinder.

4. The oven door latch system of claim 1, wherein the remotely operated adjustment actuator comprises a finger member having an engagement end and a receiver end, the finger being attached to a hydraulic cylinder on an end opposite the engagement end, wherein the finger member engages the tab member of the rotary member for rotating the rotary member upon actuation of the hydraulic cylinder.

5. The oven door latch system of claim 4, wherein the finger member includes a trough area for receiving the tab member of the rotary member when the rotary member is not engaged with the striker plate of the buck stay.

6. The oven door latch system of claim 1, wherein an engagement edge of the rotary member has a slope from one end there of to a second end thereof ranging from about 0.04 to about 0.10 millimeters per millimeter over an arcuate path of 120°.

7. The oven door latch system of claim 1, wherein the adjustment actuator is disposed on a pushing and charging machine or a utility car movable adjacent an oven for coal charging and coke discharging operations.

8. A method for reducing air leakage through a door opening of a coke oven when a coke oven door is disposed in the door opening to close the door opening, the method comprising the steps of:

providing an oven door latch system for a coke oven door, the door latch system including a rotary member rotatively attached to the oven door and having a wedge-shaped, arcuate engagement edge for variably engaging a striker plate on a buck stay member adjacent the oven door opening when the oven door is disposed in the opening of the oven, the rotary member having tab member thereon for moving the rotary member from an engaged position adjacent the striker plate to a non-engaged position remote from the striker plate;

providing a remotely operated adjustment actuator for moving the rotary member from the engaged position to the non-engaged position;

disposing the coke oven door in the door opening;

engaging the rotary member and the adjustment actuator; and actuating the adjustment actuator to rotate the rotary member so that an increasing wedge portion of the rotary member is engaged with the striker plate of the buck stay during an oven door closing operation.

9. The method of claim 8, wherein the oven door further comprises a stop member for terminating rotation of the rotary member in the non-engaged position.

10. The method of claim 8, wherein the remotely operated adjustment actuator comprises a hydraulic cylinder and a lever member, the lever member having a first end for engaging the tab member and a second end attached to the hydraulic cylinder.

11. The method of claim 9, wherein the remotely operated adjustment actuator comprises a finger member having an engagement end and a receiver end, the finger being attached to a hydraulic cylinder on an end opposite the engagement end, wherein the finger member engages the tab member of the rotary member during the actuating step thereby rotating the rotary member to the-engaged or non-engaged position.

12. The method of claim 11, wherein the finger member includes a trough area for receiving the tab member of the rotary member when the rotary member is not engaged with the striker plate of the buck stay.

13. The method of claim 8, wherein an engagement edge of the rotary member has a slope from one end there of to a second end thereof ranging from about 0.04 to about 0.10 millimeters per millimeter over an arcuate path of 120°.

14. The method of claim 8, wherein the adjustment actuator is disposed on a utility car, further comprising moving the utility car adjacent an oven for coal charging and coke discharging operations prior to actuating the adjustment actuator.

15. The method of claim 8 wherein adjustment actuator includes a two position hydraulic cylinder, further comprising actuating the cylinder from a first position to a second position to pivot a finger member adjacent the tab member of the rotary member for moving the rotary member from the engaged position to the non- engaged position.

16. An oven door latching mechanism for sealing an oven door of a furnace, comprising:

rotary wedge means attached to the oven door for variably engaging a striker plate of an oven buck stay; and actuator means remote from the oven door for rotating the rotary wedge means from an engaged position adjacent the striker plate to a non-engaged position remote from the striker plate, wherein the actuator means is disposed on a pushing and charging machine or on a utility car movable adjacent to the furnace for coal charging and coke discharging operations.

17. The oven door latching mechanism of claim 16, wherein the oven door further comprises a stop member for terminating rotation of the rotary wedge means at a predetermined location.

18. The oven door latching mechanism of claim 16, wherein the actuator means comprises a hydraulic cylinder and a lever member, the lever member having a first end for engaging a tab member on the rotary wedge means and a second end attached to the hydraulic cylinder.

19. The oven door latching mechanism of claim 16, wherein the actuator means comprises a finger member having an engagement end and a receiver end, the finger being attached to a hydraulic cylinder on an end opposite the engagement end, wherein the finger member engages a tab member of the rotary wedge means for rotating the rotary wedge means upon actuation of the hydraulic cylinder.

20. The oven door latching system of claim 19, wherein the finger member includes a trough area for receiving the tab member of the rotary wedge means when the rotary wedge means is not engaged with the striker plate of the buck stay.

21. The oven door latching system of claim 16, wherein the rotary wedge means includes an engagement edge having a slope from one end thereof to a second end thereof ranging from about 0.04 to about 0.10 millimeters per millimeter over an arcuate path of 120°.

* * * * *